United States Patent [19]

Schawann et al.

[11] Patent Number: 4,609,046

[45] Date of Patent: Sep. 2, 1986

[54] PRODUCTION RISER FOOT AND A PROCESS FOR IMPLEMENTING SAME

[75] Inventors: Jean C. Schawann, Idron; Jean P. Caumont, Pau; Jean Falcimaigne, Bois Colombes, all of France

[73] Assignee: Societe Nationale Elf Aquitaine (Production), Paris, France

[21] Appl. No.: 650,791

[22] Filed: Sep. 14, 1984

[30] Foreign Application Priority Data

Sep. 15, 1983 [FR] France ..... 83 14666

[51] Int. Cl.[4] ..... E21B 43/013

[52] U.S. Cl. ..... 166/341; 166/345; 166/359; 285/24; 285/165

[58] Field of Search ..... 166/341–345, 166/349, 359, 362; 285/24, 26, 27, 29, 165; 405/169

[56] References Cited

U.S. PATENT DOCUMENTS

| | | | |
|---|---|---|---|
| 3,486,555 | 12/1969 | Vincent | 166/359 |
| 3,486,556 | 12/1969 | Burgess | 285/26 |
| 3,500,906 | 3/1970 | Petersen | 166/341 |
| 3,605,884 | 9/1971 | Brown | 166/360 |
| 3,688,840 | 9/1972 | Curington et al. | 166/341 |
| 4,101,148 | 7/1978 | Lee | 285/24 |
| 4,171,922 | 10/1979 | Coulboy et al. | 166/341 X |
| 4,188,050 | 2/1980 | Lochte | 166/341 |
| 4,375,835 | 3/1983 | Archer | 166/341 |
| 4,457,378 | 7/1984 | Watkins | 166/347 |

FOREIGN PATENT DOCUMENTS

| | | | |
|---|---|---|---|
| 2014794 | 4/1970 | France . | |
| 2293571 | 7/1976 | France . | |
| 2025491 | 1/1980 | United Kingdom | 166/341 |

*Primary Examiner*—James A. Leppink
*Assistant Examiner*—Hoang C. Dang
*Attorney, Agent, or Firm*—Poms, Smith, Lande & Rose

[57] ABSTRACT

A system is provided for guiding the central tube connector of a production riser for positioning same on an underwater well head installation. The central tube carries, during lowering, a support integral with the tube and formed by a horizontal plate having on its periphery a truncated cone shaped collar widening out towards the bottom, a guide funnel which freely rests on said support having a shoulder also widening out towards the bottom. The tube is lowered until said funnel is engaged on the installation head then, continuing the descent, the tube no longer supports the weight of the funnel and the connection may take place in a conventional way.

5 Claims, 3 Drawing Figures

PRODUCTION RISER FOOT AND A PROCESS FOR IMPLEMENTING SAME

BACKGROUND OF THE INVENTION

1. Field of the Invention

The present invention relates to a system for guiding the central tube connector of a production riser and more particularly a riser foot having a connector for locating same on an underwater well head as well as a process for implementing same.

2. Description of the Prior Art

In known systems, location of the connector on a well collecting head is effected by means of a central tube at the end of which a guide funnel is permanently fixed. According to French Pat. No. 2 293 571 in the name of the applicant, filed on the Dec. 5, 1974, once the guide funnel is fixed to the underwater well head, the connector is lowered by means of a system of hydraulic jacks placed between the central tube and the connector. The use of hydraulic jacks at great depth may prove delicate and the aim of the present invention is to position the connector without using any hydraulic control.

SUMMARY OF THE INVENTION

The invention provides a production riser foot having a connector for connecting a central tube with underwater well-head equipment and comprising a guide funnel having a conical skirt fitting on a corresponding truncated cone shaped part of the underwater equipment for centering the connector on the head of the equipment. For this, during lowering of the riser, the central tube supports by means of a support integral with a tube a guide funnel resting freely on said support and whose upper part, above the skirt, has a shoulder widening out towards the bottom and resting freely on said support integral with said central tube.

The support may be formed by a circular horizontal plate fixed to the tube by means of a sleeve and supporting on its periphery a truncated cone shaped collar widening out towards the bottom, on which the internal face of the guide funnel bears shaped as a downwardly widening shoulder. The horizontal plate is pierced with concentric openings for passing therethrough peripheral stringers having connectors at their ends.

The invention also provides a process for constructing a riser foot such as described and according to which, during positioning, the central tube carrying the connector and, suspended by means of an annular support, the guide funnel is lowered; as soon as the guide funnel has come to bear with its truncated cone shaped skirt on the underwater well head equipment, the connector and the tube are released from the guide funnel and continue their descent, being coaxial with the tubular end of the underwater equipment and lowering of the tube continues until the connector is locked on said tubular end.

BRIEF DESCRIPTION OF THE DRAWINGS

Other features of the invention will appear from the description of one embodiment with reference to the accompanying drawings in which.

DESCRIPTION OF THE PREFERRED EMBODIMENT

Figure 1:
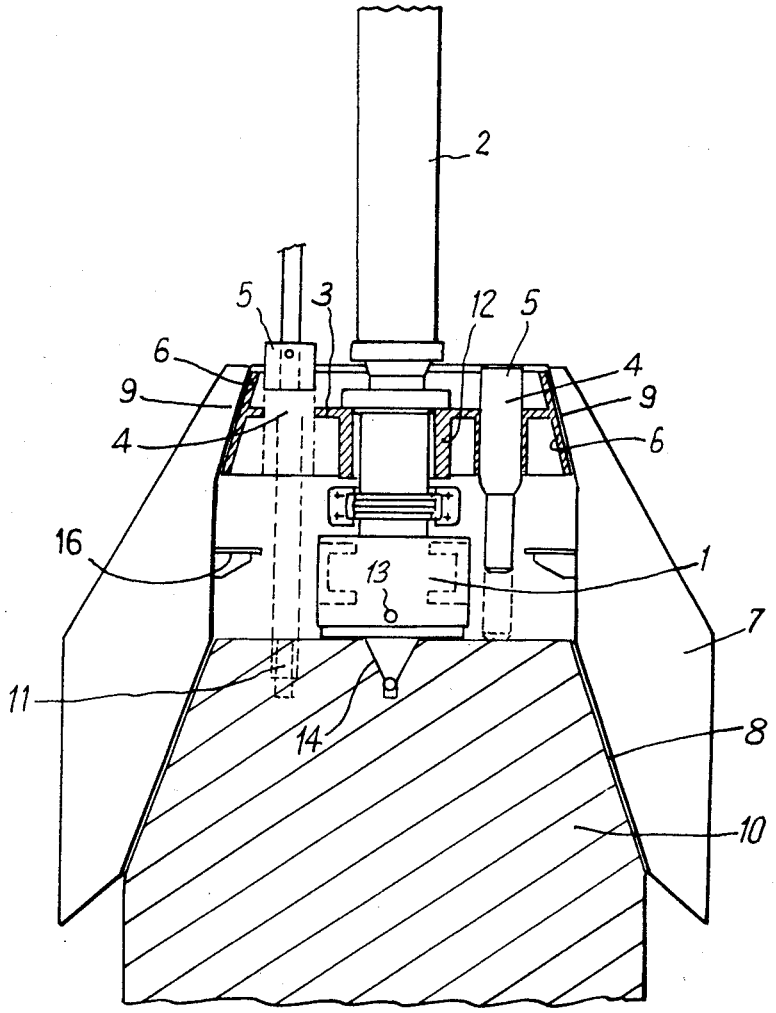
FIG. 1 shows a vertical section view of the riser foot during lowering and the bearing engagement of the guide funnel.

At the end of the central tube 2 accompanied by the cluster of peripheral production stringers 5 is fixed a connector 1 of conventional type having an annular orientation stud 13 intended to cooperate with the ramps 14 in the housing of the connector formed in an underwater well head installation 10 provided with a vertical conduit endpiece.

By means of a sleeve 12 shrunk on the end of tube 2 is secured a horizontal plate 3 having openings 4 for passing peripheral stringers 5 with connectors 11 therethrough.

This plate 3 has on its periphery a truncated cone shaped collar 6 widening out towards the bottom.

On its inner face the guide funnel 7 has two truncated cone shaped bearings surfaces widening out towards the bottom: at its upper part a shoulder 9 for causing the funnel to rest freely on the truncated cone shaped collar 6 carried by the horizontal plate 3 and, at its lower part, a skirt 8 fitting on the corresponding part of the underwater well head installation. The slopes 9 and 8 and the respective distances between these slopes and the length of the attachment of connector 1 are calculated so that, when skirt 8 rests on head 10, the lower face of the connector only brushes the upper face of the underwater well head installation, the connector remaining suspended above and coaxial with the endpiece of the underwater well head installation.

An annular bearing surface 16 is fixed to the inner face of the guide funnel 7 in a zone situated between the upper end of the truncated cone shaped bearing surface 8 and the lower end of the truncated cone shaped part 9. Said bearing surface 16 allows the funnel 7 to be set down for storage on the quay and also serves as travel limiter and safety member when, during the approach phase, the axis of the funnel deviates with respect to the axis of the tube and of the connector.

In so far as the connection of the peripheral stringers 5 is concerned, mechanical connection may be provided on the horizontal plate 3 by means of a device described and claimed in U.S. patent application Ser. No. 651,218, filed Sept. 14, 1984 and owned by a common assignee.

Figure 2:
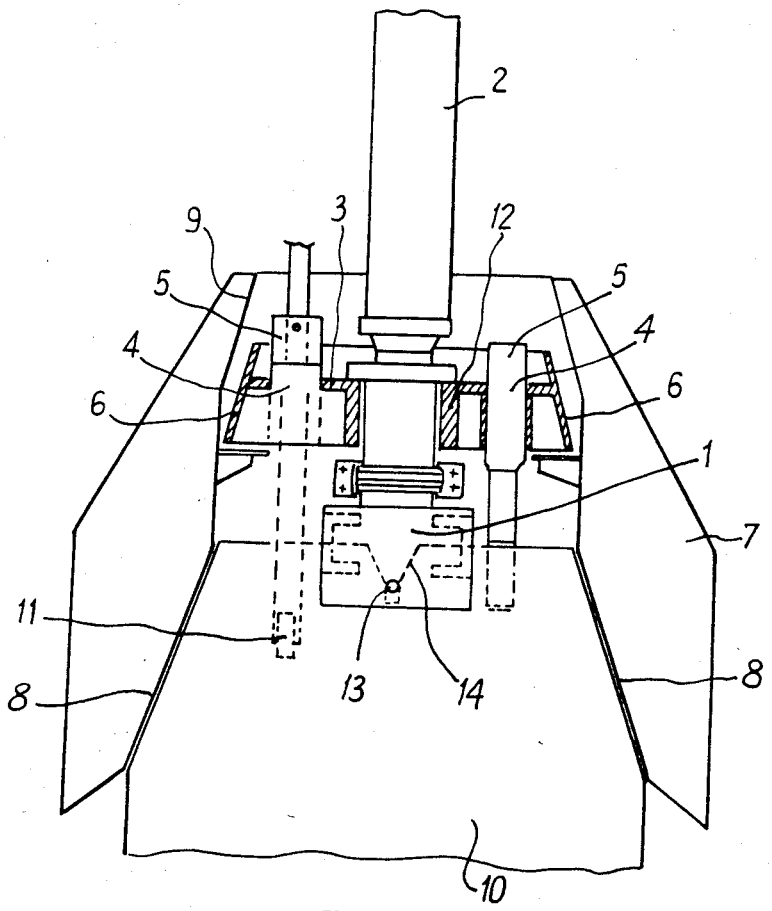
FIG. 2 is a vertical sectional view after positioning of the connector and locking thereof in the underwater well head.
Figure 3:
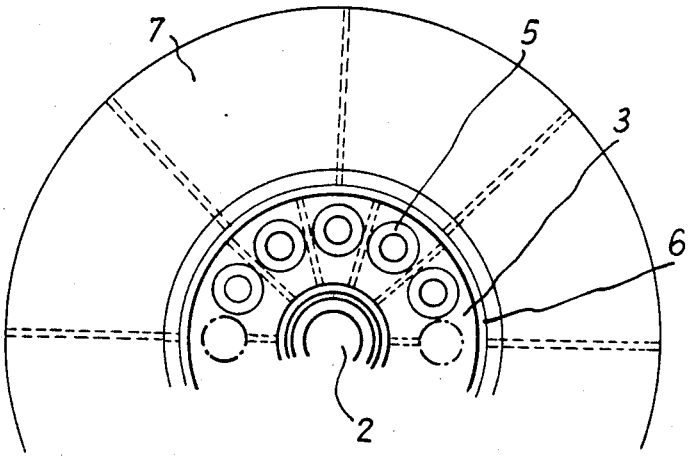
FIG. 3 is a top view.

Positioning of the connector takes place in two stages. Tube 2 carrying the guide funnel is lowered until funnel 7 is engaged on the well head installation 10 by means of its skirt 8. Then by further lowering (FIG. 2), since the tube no longer supports the weight of the funnel, the connector penetrates inside the housing formed in the underwater well head installation 10 and, guided by ramps 14 by means of the angular orientation stud 13, engages inside the housing where it is locked in a conventional arrangement.

The advantage of the invention resides in the fact of requiring no hydraulic control for the approach phase. The handling of the device is therefore very reliable and the device is well adapted to deep sea working.

The invention is not limited to the embodiment described. Modifications may be made thereto by a man skilled in the art without for all that departing from the scope and spirit of the invention. Thus, support 3, 6 may have a different shape, for example the shape of radial arms carrying truncated cone shaped bearing surfaces at their ends. Also, the guide funnel 7, instead of an inner face of revolution, may have a prismatic shape.

What is claimed is:

1. In a production riser foot for connecting a central tube having a connector with an underwater well head comprising, in combination:

a support means carried by said central tube and having a truncated collar surface radially outwardly spaced from said tube;

a guide funnel having an internal shoulder surface of corresponding shape as said collar surface and freely resting thereon for limited axial misalignment with respect to said central tube;

said guide funnel having a skirt with an internal surface radially outwardly from said internal shoulder surface and spaced axially therefrom for centering the connector and central tube with respect to the well head;

said truncated collar surface supporting said guide funnel at said internal shoulder surface for carrying said funnel during lowering of the central tube, connector, and funnel toward said well head;

said truncated collar surface being separable from the internal shoulder surface of the guide funnel after said funnel skirt is engaged with said well head for continued lowering of the central tube and connector for making the connection with the well head.

2. The riser foot as claimed in claim 1 wherein said support means includes a circular horizontal plate;

and a sleeve securing said plate to the central tube.

3. A riser foot as claimed in claim 2 wherein said horizontal plate is provided with a plurality of concentric openings adapted to pass therethrough peripheral stringers.

4. A riser foot as claimed in claim 1 wherein:

said guide funnel includes an internal annular bearing surface between said skirt and said internal shoulder surface for limiting travel of the guide funnel when the axis of the funnel is misaligned with respect to the axis of the central tube and connector carried thereby during positioning of the guide funnel.

5. A production riser foot for a subsea well head having a riser foot engaging surface comprising, in combination:

a central tube carrying a connector thereon for connection to the subsea well head;

a support plate carried by said central tube and having a circumferential truncated support surface spaced radially outwardly of said tube;

a guide funnel having upper and lower axially and radially spaced internal bearing surfaces, said upper bearing surface having free resting contact with the circumferential surface on the support plate for relative alignment movement with respect thereto during lowering and alignment of the central tube and connector with the guide funnel associated therewith with respect to the well head, said lower internal bearing surface on said guide funnel being adapted to rest on a corresponding surface on the well head;

said support plate being movable with said central tube and when said guide funnel rests on said well head, said support surface is disengaged from said upper bearing surface on said guide funnel for lowering of the central tube and connector carried thereby for aligned connection at the subsea well head.

* * * * *